United States Patent [19]

Aranda Lopez et al.

[11] 4,221,297

[45] Sep. 9, 1980

[54] ELECTRONIC FRUIT GRADING MACHINES

[76] Inventors: José M. Aranda López, Nº 5 y 7 1º Pintor Rosales; Jose R. Conde Hinojosa, Felipe II 30-6º; Juan R. Jimenez 25, all of, Sevilla, Spain

[21] Appl. No.: 902,834

[22] Filed: May 2, 1978

[30] Foreign Application Priority Data

May 4, 1977 [ES] Spain ..... 458.478

[51] Int. Cl.[2] ..... B07C 5/00

[52] U.S. Cl. ..... 209/576; 209/936; 209/939; 209/905; 209/914; 209/644

[58] Field of Search ..... 209/936, 644, 939, 905, 209/914, 576; 198/443, 689

[56] References Cited

U.S. PATENT DOCUMENTS

| | | | |
|---|---|---|---|
| 2,169,353 | 8/1939 | Carroll | 198/443 |
| 3,013,661 | 12/1961 | Strubhar | 209/914 |
| 4,122,951 | 10/1978 | Alaminos | 209/939 |

*Primary Examiner*—Allen N. Knowles
*Attorney, Agent, or Firm*—Wenderoth, Lind & Ponack

[57] ABSTRACT

An electronic fruit grading machine includes an endless chain having positioning rollers or bars which rotate and on which the fruit coming from a hopper is positioned in rows. The grading machine includes an electronic apparatus capable of detecting surface marks or defects in the fruit which is situated on the bars. The fruit is arranged in transverse rows and is displaced at a certain speed under a standard television camera. The feed of the fruit from the hopper to the endless chain is carried out by a cylindrical drum acting as a feeding device. On the surface of the cylindrical drum are rows of holes, and adjacent each hole is provided a wedge, one face of which follows the prolongation of a radius of the cylindrical drum and is arranged for the expulsion of extra fruit adhered to the periphery of the cylindrical drum.

8 Claims, 12 Drawing Figures

ELECTRONIC FRUIT GRADING MACHINES

BACKGROUND OF THE INVENTION

The present invention relates to improvements in electronic fruit grading machines and more specifically in such machines for grading olives, according to the quality thereof.

This type of olive grading machine detects surface marks or defects, so that, coupled to a suitable mechanical system, it replaces with outstanding advantages present-day methods of manual grading.

Presently there are industrial systems for grading objects by using standardized and specific television cameras, such systems constituting the basis for the improvements of the present invention.

The process is carried out by an electronic system including an optoelectronic transducer, so that the grading of olives in determined groups is achieved by corresponding electric signals generated by the transducer. The system can operate with a television camera provided with a silicon multidiode acting as the transducer.

From the electric signals coming from the camera, the system carries out the following functions:

(a) Locating a particular olive under observation.

(b) Extracting necessary information regarding each olive found in the preceding process.

(c) Assigning, according to external controls, to each olive analyzed in the preceding process a determined class or quality.

(d) Generating electric signals capable of acting on a suitable electromechanical grading system.

Presently, grading of olives by their surface defects, normally corresponding to small or large-sized marks produced before or after fermentation, is carried out manually. This requires a large amount of hand labor, with the disadvantages inherent to any type of visual grading wherein fatigue and the subjectivity of the personnel involved in such work intervene very directly.

SUMMARY OF THE INVENTION

The system of this invention advantageously replaces this type of manual grading, solving at the same time other problems not related thereto.

Since it is necessary, for the observation of the olives through a television camera, for the olives to be aligned and to have a certain rate of advance, a conveyor is provided to carry out such function.

That is to say, the electronic fruit or olive grading machine of the present invention is of the type which has an endless conveyor having positioning bars which turn in the direction of movement and on which the fruit coming from a hopper is arranged in rows, and of the type which includes an electronic apparatus capable of detecting marks or defects on the surface of fruit positioned between the bars and removing fruit having such detected marks or defects. The fruit is arranged in transverse rows and is displaced with a certain speed under a standard television camera.

One of the improvements of the invention is that between the hopper and one of the ends of the conveyor having positioning bars there is arranged a feeding device formed by a cylindrical drum extending across the conveyor and having a peripheral surface with holes arranged in parallel rows. The rotation of the drum is opposite to that of the positioning bars. Within the interior and in the lower part of the drum is a fixed longitudinally extending inverted U-shaped member having edges contacting the inner surface of the drum. To the interior of the drum there is connected a vacuum source, while to the interior of the inverted U-shaped member there is connected a source of pressure higher than atmospheric pressure.

The vacuum existing in the interior of the drum causes the olives to adhere to the mouths of the holes in the drum. When the holes, due to rotation of the drum, occupy positions facing the inverted U-shaped member, the over-pressure existing in the interior thereof causes the fruit to become loosened and to fall onto the lower conveyor having positioning bars.

The electronic fruit grading machine of the invention further includes, at a central zone of the upper run of the conveyor having positioning bars, an electronic apparatus including a television camera which detects surface defects of the fruit which pass through the field of view of the camera. This electronic apparatus includes a series of light sources which pass through diffuser plates. The entire assembly including the electronic apparatus and the conveyor having positioning bars is completely closed by a housing, so that light cannot pass from the exterior into the interior.

The television camera sweeps a scan path corresponding to a length of the conveyor including more than three complete rows of fruit. Thus, the system simultaneously analyzes two complete rows of fruit in the field of observation of the camera. For this purpose the system has a control block which programs electric signals corresponding to the detection of each fruit and extracts information necessary for grading the fruit as a result of such signals. This control block includes three independent intermediate programming units which each analyzes a separate rather determined condition of each fruit. The three programming units include a scanner of small surface marks, a scanner of shade and a scanner of large-sized surface marks. A memory collects the information corresponding to the three programming units, thus determining in a grading unit the quality group to which the fruit to be graded pertains.

Another improvement in the electronic grading machine of the invention is such a memory for storing information corresponding to the scanned fruit. The memory is between the electronic apparatus and an electromechanical system for ejecting unacceptable fruit. The grading machine also has a temporary delay, the storage and delay units being in a block. The machine also is provided with a counting unit which represents, by luminescent digits, the number of kilograms of fruit scanned during a determined period of time, as well as another similar visual unit which represents the number of kilograms of fruit selected for each quality.

Another improvement of the invention involves a cleaning spray which is directed downwardly for cleaning the bars during their lower run of travel.

The electromechanical system includes a series of electrovalves arranged in a row and in a total number equal to the number of fruit conveyed in a row between two adjacent bars. The electrovalves are normally closed, but they eject a blast of air under pressure directed against corresponding fruit which has been graded as unacceptable, thereby rejecting the same and conveniently separating the good fruit from the bad fruit. Each electrovalve receives an order from the electronic apparatus to initiate an ejection operation.

To prevent turbulence created by a given one of the electrovalves during the activation thereof from affecting olives which occupy sites close thereto and which are not to be expelled, there are arranged plates which serve as separating partitions between the olives in the area of removal thereof from the conveyor.

Another improvement of the invention is that on the outer surface of the rotary cylindrical drum, constituting the feeding device, there is provided a double comb device comprised of two like comb-shaped members resting against each other and capable of mutual relative displacement, to thereby increase or decrease the size of openings for the passage therethrough of fruit, depending on the size thereof. The comb device permits the passage therethrough only of fruit which is positioned at rest within respective holes of the drum.

The cylindrical feeding drum may be provided with a device other than the U-shaped member maintained under pressure for expelling the olives from the drum onto the conveyor. Thus, such purely pneumatic operation may be replaced by a half pneumatic and half mechanical operation or by a completely mechanical operation.

To this end there are provided embodiments wherein the drum has on the outer surface thereof, adjacent each hole therein, a wedge-shaped protrusion having one face corresponding to a prolongation of a radius of the cylindrical drum. Also, there is provided within the drum a roller, a star shaft or a comb shaft for removing fruit adhered to the periphery of the drum. Such elements have means for adjusting the height thereof with respect to the inner surface of the drum.

A central support shaft of the cylindrical drum is connected to the suction line which is provided with rollers for guiding and ensuring smooth rotation of the drum.

The roller within the drum is arranged on a shaft, is made of an elastic material and rolls on the inner face of the cylindrical drum with a certain pressure. The star shaft includes a plurality of rows of stars or rods which project slightly from a cylinder arranged substantially tangent to the inner surface of the drum, the number of rods in each row of rods being equal to the number of holes in each row of transverse holes in the drum. The spacings between outer ends of each two adjacent rods are the same as that of two consecutive holes of the cylindrical drum.

The comb shafts are supported at their ends on circular discs which are supported at their centers on shafts, one or more rings being placed eccentrically with respect to the discs. The rings are mounted on shafts extending between two consecutive prongs supported by the comb shafts. Each one of the comb shafts has as many prongs as there are transverse rows of holes in the cylindrical drum. Wheels move on the periphery of the rings, which wheels are supported by the shaft of the cylindrical drum.

The suction end of the cylindrical drum is provided with an outer arrangement of circular reinforcements, so that the end support of the shaft of the drum is carried out by a rod joined at the bottom thereof to the shaft and at the top thereof to the front surface of the air extraction line.

A cylindrical brush is arranged parallel to and above the cylindrical drum and has a circumferentially recessed periphery with circumferential projections positioned between adjacent circumferential rows of holes of the drum.

The electronic fruit grading machine of the invention provides the following advantages:

Improvement in the production yield.

Improvement in the quality of grading.

Improvement with respect to a reduction in the dimensions of a complete grading unit.

Improvement in costs as compared with the present-day manual process.

Improvements with respect to the scheduled availability of the system.

Improvements as a result of the direct reading of the yields produced.

Improvements as a result of scanning two rows simultaneously which results in an increase in the quality.

BRIEF DESCRIPTION OF THE DRAWINGS

To complement the description which will subsequently be made and for a better understanding of the characteristics of the invention, reference is made to the attached drawings, wherein.

DETAILED DESCRIPTION OF THE INVENTION

Figure 1:
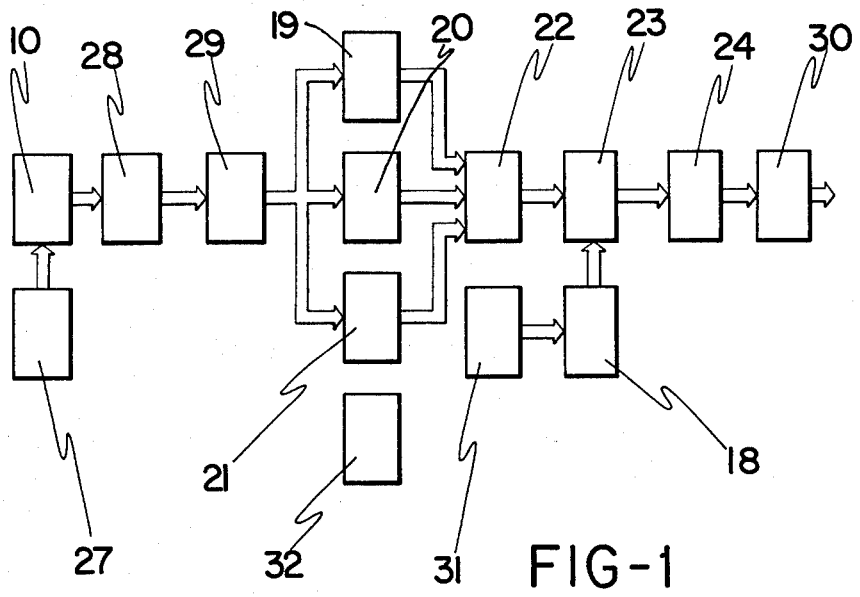
FIG. 1 is a schematic block diagram of the electronic system of the fruit grading machine of the present invention.
Figure 2:
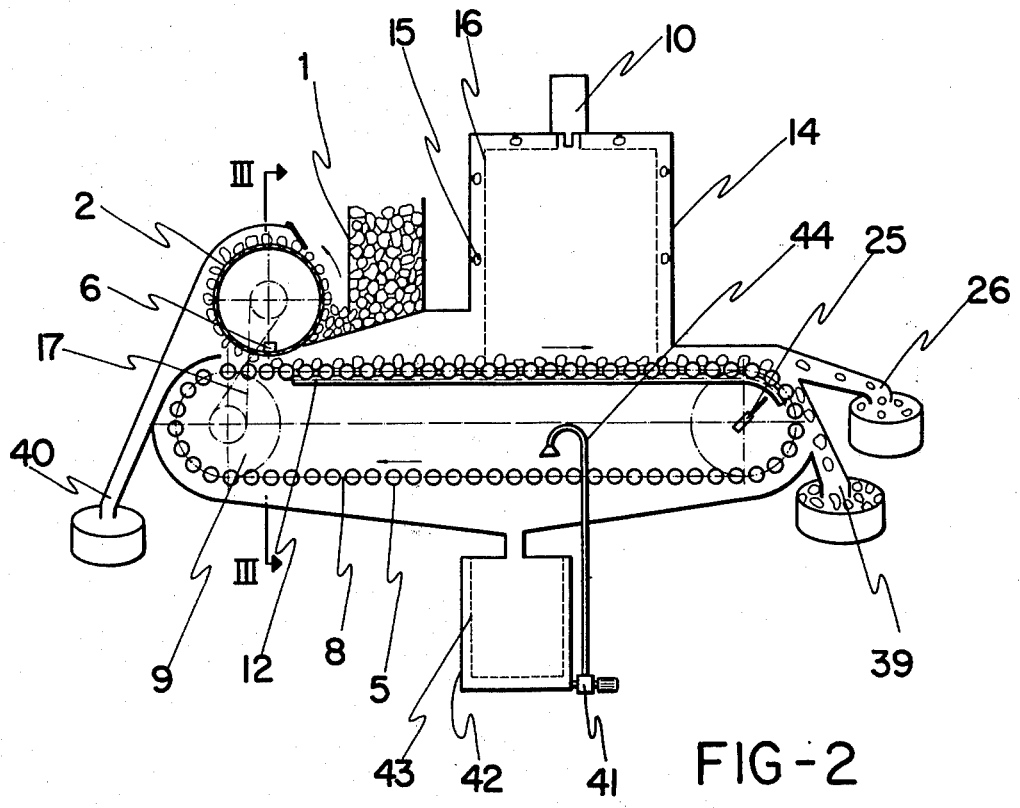
FIG. 2 is a side view of the electronic grading machine according to the invention.
Figure 3:
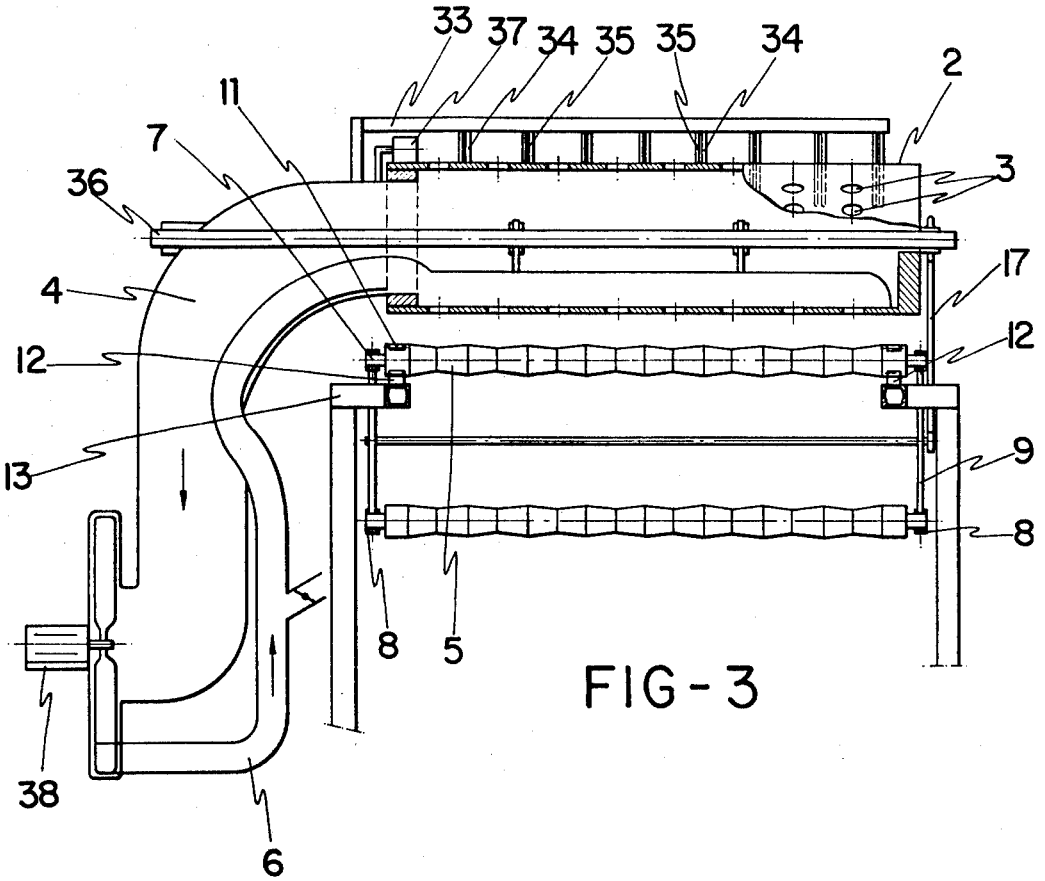
FIG. 3 is a sectional view taken along line III—III of FIG. 2.

The drawings illustrate how the fruit to be graded, preferably olives, is housed in a hopper 1 which, by means of a ramp, supplies the fruit in a distributor cylinder 2 which has a plurality of holes 3 in its periphery, which holes are aligned with each other both longitudinally or circumferentially and transversely.

The distributor cylinder 2 is connected at one of its ends to a suction line 4 for the purpose of retaining the olives to be graded in the holes 3 in cylinder 2. For the transfer of the olives from the cylinder 2 to conveyor rollers 5 there is provided a supply of pressurized air through a pipe 6 into the interior of the distributor cylinder 2.

Air pipe 6 is fixed along the inner surface of the distributor cylinder 2 and is provided with a generally inverted U-shaped profile of a size sufficient to cover completely a row of holes 3 which are moved through the zone of pipe 6 due to rotation of the distributor cylinder 2.

The olives or fruit to be graded are conveyed from the hopper 1 to the conveyor rollers 5, first on the cylinder 2 by application of suction through holes 3, and then when a row of holes 3 reaches pipe 6, air from pipe 6 forces the olives or fruit from the row of holes of distributor cylinder 2 and deposits them on the conveyor rollers 5. Thus, the upper portion of pipe 6 is positioned within the interior of the suction line 4.

To convey the olives to be graded and to effect their passage through the grading machine, there is provided an endless conveyor formed by the conveyor rollers 5 mounted and conveyed by any conventional conveyor belt system. One such system is illustrated and includes small shafts 7 attached to the conveyor rollers 5 and provided in the centers of articulation of links of conveyor chains 8, this conveying system being readily carried out, since it is sufficient to delete some of the rivets for linking of the links and replacing them with the corresponding shafts 7. The chains 8 are mounted on respective toothed wheels 9, one of which has imparted thereto a driving movement.

Once the fruit is placed on the conveyor rollers 5, the fruit should be turned so that the complete periphery thereof is in the field of observation of a television camera 10, this being achieved by an independent rotating movement of the conveyor rollers 5, in the direction of their movement of advance, for which purpose the end cylinder-shaped portions of conveyor rollers 5 have toothed zones 11. These toothed zones 11 mesh with racks 12 positioned on opposite sides of a frame 13.

Furthermore, and to facilitate placing of the olives on the conveyor rollers 5, the distributor cylinder 2 is turned by means of a chain 17, in a direction opposite to the direction of rotation of the toothed wheels 9. To prevent two or more olives from being placed in each hole 3, due to the suction force applied thereto, there is arranged on top of the distributor cylinder 2 a comp-shaped device 33 which includes fixed prongs 34 having thereon other prongs 35 which move at will. The prongs 34 and 35 are mounted and function in a manner such that when the prongs 35 are properly adjusted, with respect to the thickness of the olives to be graded, the passage of only one olive is permitted.

Likewise, the distributor cylinder 2 is mounted on a shaft 36 fixed to the suction line 4 and to the air pipe 6. The suction line 4 has mounted thereon small rotating rollers 37 which allow rotation of cylinder 2 while preventing axial movement thereof.

The television camera 10 is mounted in a housing 14 in the interior of which there are lamps 15 as well as a translucent glass 16 for the diffusion of the light generated by the lamps 15.

As previously explained, the process requires the olives to be situated on a conveyor belt, arranged in transverse rows and displaced with a certain linear speed below the television camera 10 and in the direction of the line of sweep thereof. This arrangement of the olives on the conveyor belt is achieved due to the shape of the conveyor rollers 5, since the olives coming from the distributor cylinder 2 are deposited in recessed areas formed between each adjacent pair of conveyor rollers 5. Thus, at the rate that the conveyor rollers 5 advance and as a result of the rotation thereof, the olives situated in their respective recessed areas also turn in a direction opposite to that of the rollers. Therefore, the complete surfaces of the olives face the television camera 10 which observes and studies the olives which pass along its field of vision.

To study the olives it is necessary for the field of the camera to correspond to a certain length of conveyor and to include more than three complete rows. With this arrangement the system is capable of scanning two complete rows simultaneously in its field of observation. The electronic system then individually inspects each one of the olives present in the field of vision of the television camera 10. Since there are two complete rows in each scanning cycle of operation, each olive is examined in two consecutive cycles, thus achieving in this way a redundance in examination which leads to an increase in quality in the grading process.

With reference to the block diagram represented in FIG. 1, the function of finding and marking corresponds to a control block 18. Once an olive has been scanned, the system produces an electric signal corresponding to each olive, and extracts information necessary for the olive to be graded. The system has three independent intermediate programming units, each one scanning a different very determined condition of each olive. These intermediate programming units have the following functions:

1. Block 19 scans for superficial and small marks on the olive.
2. Block 20 scans the shade of the olive.
3. Block 21 scans for superficial, large-sized marks on the olive.

The information on the olives collected by the intermediate programming units 19, 20 and 21 is gathered by a memory 22, the quality group to which the olives to be graded pertain being determined by a grading unit 23.

To adjust the degree of quality of the olives to be graded in the grading unit 23, there are two external controls for adjustment, which have not been represented in the drawings.

Since the olives scanned by the television camera 10 need a period of time to reach a rejection and discharge zone, it is necessary for the entire system to have a memory for the storage of information corresponding to the scanned olives, inasmuch as electromagnetic grading devices of the system do not normally act simultaneously with the detection. Between the electronic grading and the subsequent actuation of electromechanical systems of the invention there should exist a temporary delay, which delay is generated intermittently by the system itself, both the storage and delay units being shown as included in the block 24 of the diagram represented in FIG. 1.

The electromechanical systems correspond to electrovalves 25 situated below the discharge end of the conveyor of rollers 5, so that there will be as many electrovalves 25 as recessed areas provided between a pair of conveyor rollers 5.

When a surface defect is detected by the television camera 10, a signal is generated through the complete electronic system and reaches, with a predetermined delay, the respective electrovalve 25, precisely at the moment at which the respective olive passes over or through the area of the electrovalve 25, which is then operated to eject a jet of air under pressure which separates the respective olive from the normal outlet and causes such olive to discharge through a reject outlet 26.

The system is provided with a counting unit, the purpose of which is to represent visually by luminescent digits, the number of kilograms of olives scanned by the system during a working day. This control takes place from an initial setting to zero and from the inlet into the machine by external controls of the data corresponding to the average unitary weight of the type of olives under treatment.

A similar visual unit which represents the number of kilograms of selected olives is also provided, with all such operations shown included in block 32.

The complete electronic system includes auxiliary or complementary units which correspond to a pulse generator 31, a sweeping unit 27, signal amplifiers with prior filtering 28 and 29, and a power outlet unit 30 to control the electromechanical units.

The assembly also has an air suction-expulsion turbine 38, and the complete assembly of the machine or electronic grading machine is enclosed by an extension of the housing 14 in which outlets 26, 39 and 40 are situated.

All the olives which do not have surface defects are collected at the outlet 39, while any olives which, for any reason, are unfastened from the distributor cylinder 2 fall through the outlet 40.

The conveyor rollers 5, during the lower run of their path of travel, are washed of possible residue by a spray 44 which, through a motor pump 41, raises water from a tank 42. This tank has at the bottom thereof a filtering mesh 43 to retain the residue coming from the conveyor rollers 5.

Figure 5:
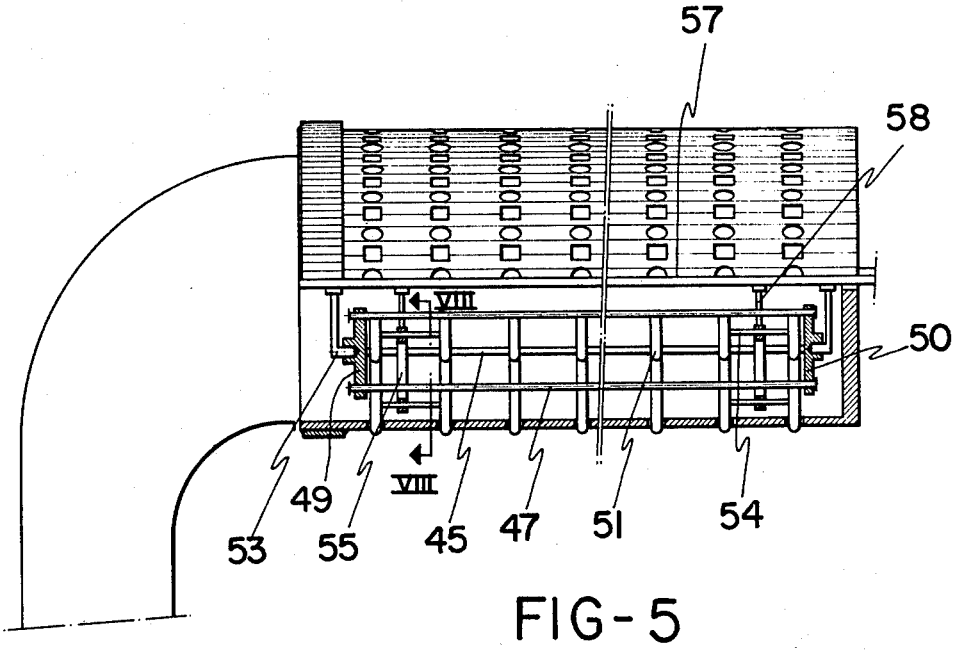
FIG. 5 is a partial section view of the distributor cylinder incorporating a fruit expelling device in the form of comb shafts.
Figure 4:
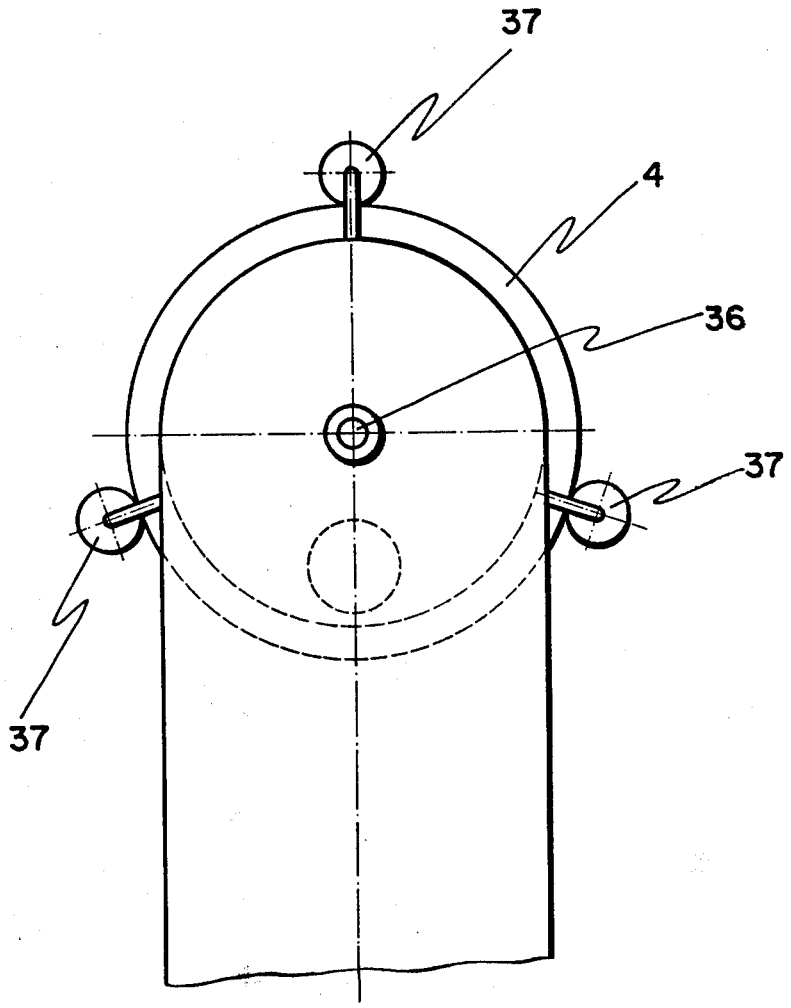
FIG. 4 is a schematic end view of a fruit distributor cylinder according to the invention supported for rotation by rollers.
Figure 8:
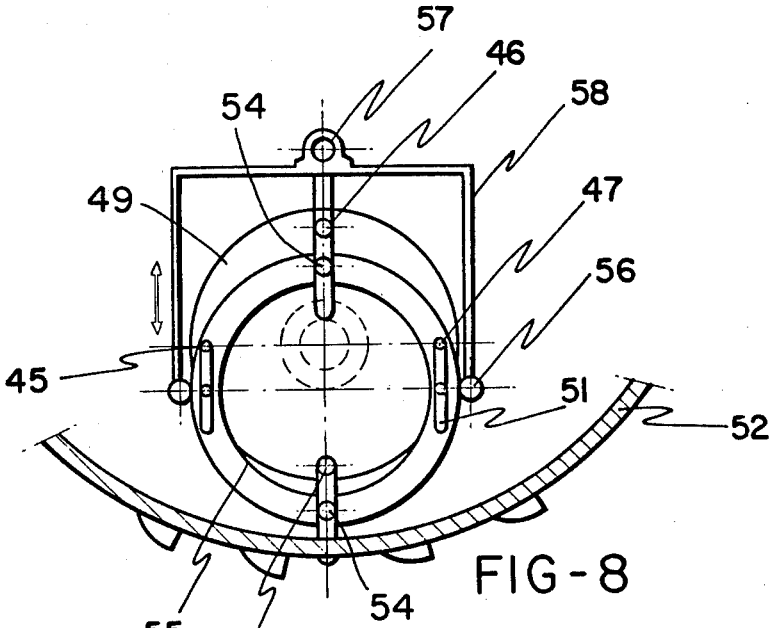
FIG. 8 is a sectional view taken along line VIII—VIII of FIG. 5, wherein the arrangement of prongs and discs of such embodiment can be seen.

Another embodiment of the device for transferring the olives from cylinder 2 to rollers 5 is shown in FIGS. 5 and 8. This fruit expelling system or mechanism includes a plurality of comb shafts. The functioning of such comb shafts is based on the mathematical principle that, when two circumferences are moved eccentrically, elements between the peripheries of the two circumferences are always parallel to a line joining the centers of the circumferences. That is to say, if parallel radii are drawn from the respective centers of the circumferences to their peripheries, the determined segment is always parallel to a line joining the centers.

The device of this embodiment includes four comb shafts 45, 46, 47 and 48 firmly supported on the peripheral areas of discs 49 and 50 in a manner such that rotation of discs 49 and 50 will rotate shafts 45, 46, 47 and 48.

The shafts 45, 46, 47 and 48 each support prongs 51, adjacent of the prongs 51 having a distance therebetween equal to the distances between two consecutive adjacent holes of the cylindrical drum 52.

The discs 49 and 50 are centrally mounted about shafts 53 for rotation thereabout.

Shafts 54 are provided to extend between two axially adjacent prongs 51, and shafts 54 pass through respective circular discs 55. As shown in FIGS. 5 and 8 the axes of discs 55 are positioned eccentrically with respect to the axes of discs 49 and 50. To prevent lateral movement of discs 55 and to therefore always maintain the vertical spacing between the two centers of the two circumferences, i.e. the axes of discs 55 form the center of one circumference and the axes of discs 49 and 50 form the center of the other circumference, rollers 56 act on the peripheries of and position the circular discs 55. Rollers 56 are supported on the main shaft 57 of the cylindrical drum 52 by means of shafts or arms 58.

Rotation of the cylindrical drum 52 causes first prongs 51 which at such moment are introduced in the holes of the cylindrical drum to be pulled, thereby rotating the discs 49 and 50 about shafts 53, so that these first prongs start to abandon the holes, and second prongs of the following comb shaft start to be introduced in the corresponding following holes, therefore expelling olives therefrom. Discs 55 and shafts 54 ensure the proper alignment of the prongs for entry into the holes of the drum.

Figure 7:
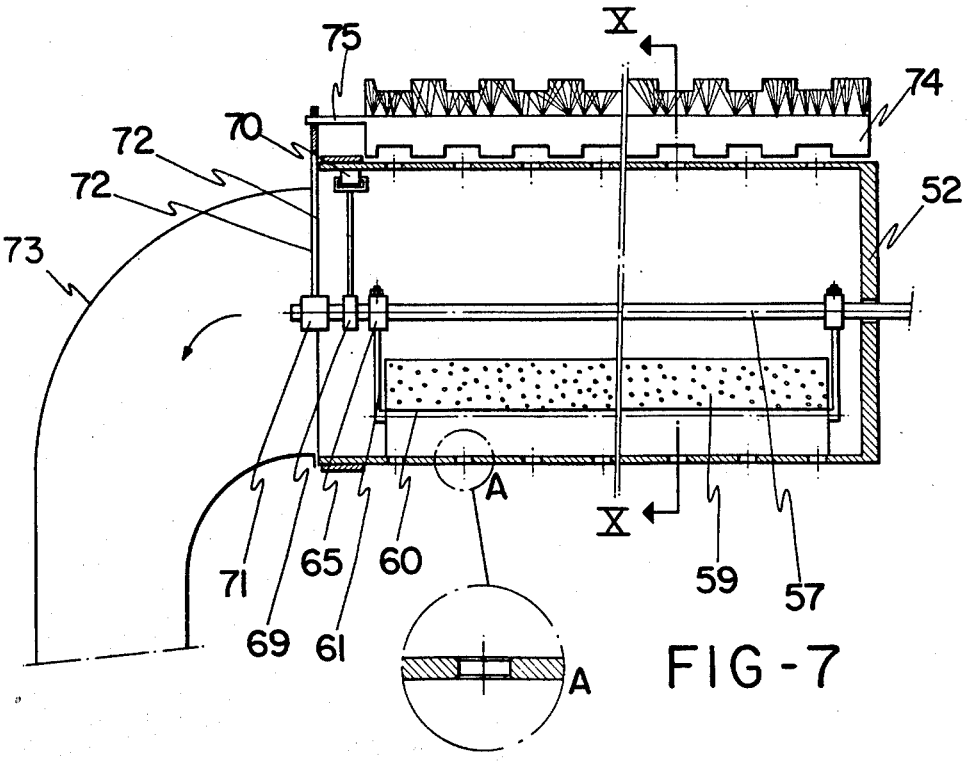
FIG. 7 is a view similar to FIGS. 5 and 6, but of another embodiment of an expelling device in the form of a roller, with detail A illustrating the configuration of each of the holes of the distributor cylinder.
Figure 10:
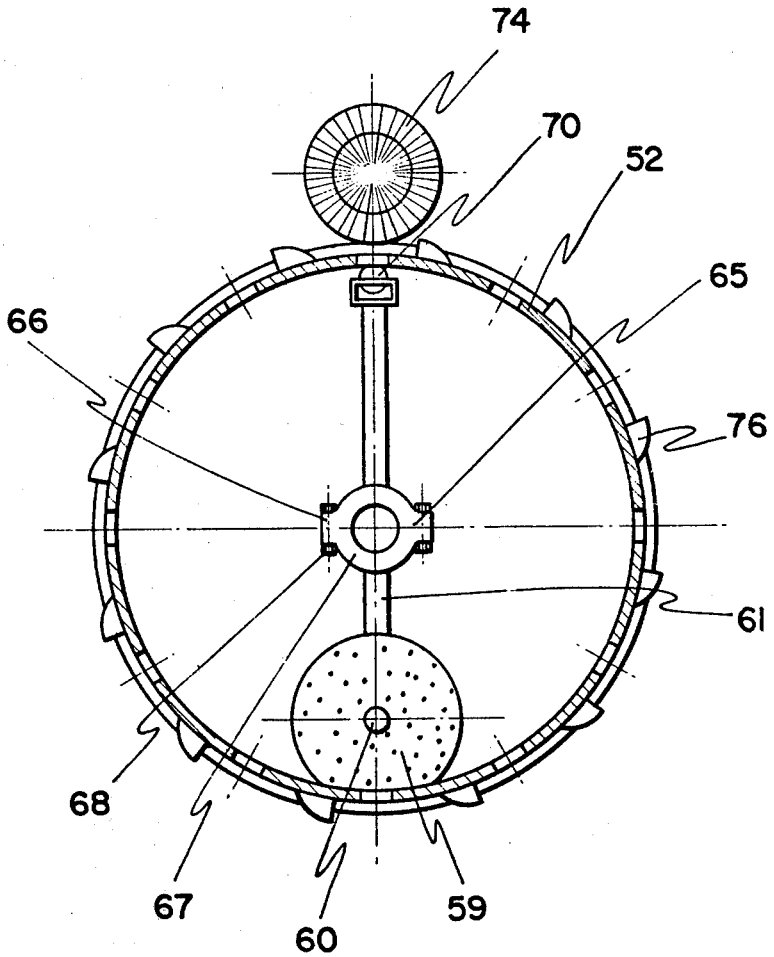
FIG. 10 is a sectional view taken along line X—X of FIG. 7.

FIGS. 7 and 10 illustrate another embodiment of the mechanism for expelling the fruit by means of rollers. Since the olives are adhered to the holes of the cylinder due to suction applied to the interior of the drum, in this embodiment the holes are covered interiorly of the drum at the time the fruit is to be expelled, thus allowing the fruit or olives to become unfastened from the holes by removing the suction.

To cover the holes there is arranged in the interior of the cylindrical drum 52 a rubber roller 59 having a determined hardness. For the covering of the holes to be as perfect as possible, the roller 59 rotates while contacting the inner face of the cylindrical drum 52 with pressure. The roller 59 turns freely on a fixed shaft 60 which is supported on the shaft 57 by arms or shafts 61.

Figure 6:
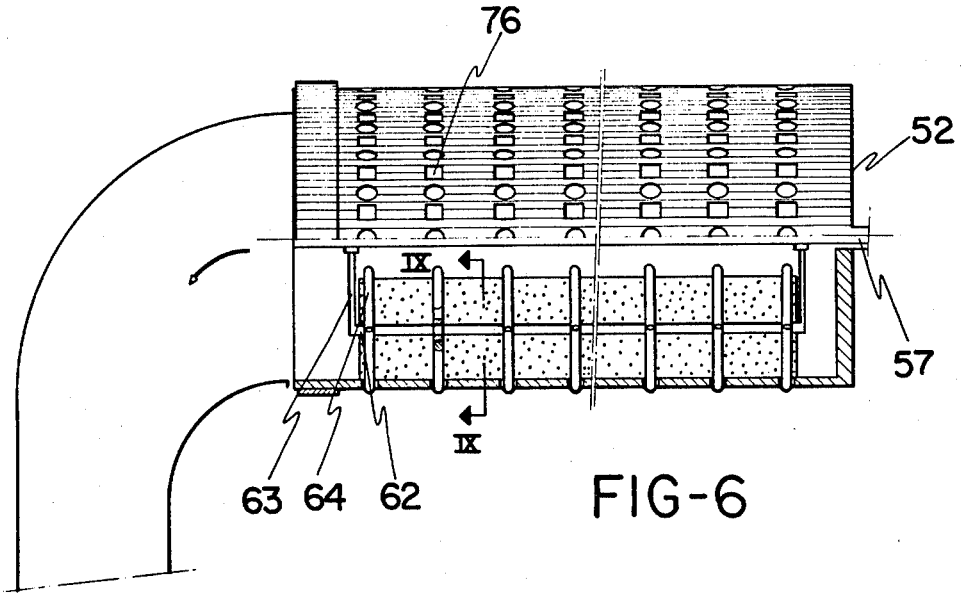
FIG. 6 is a view similar to FIG. 5, but of another embodiment of an expelling device in the form of a star shaft.
Figure 9:
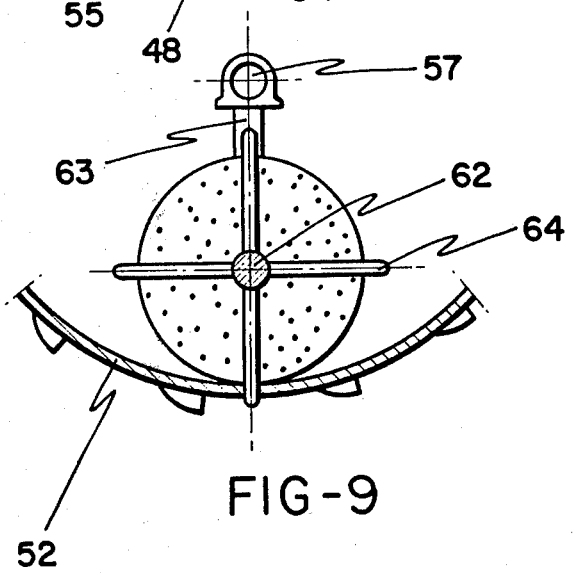
FIG. 9 is a sectional view taken along line IX—IX of FIG. 6.

FIGS. 6 and 9 illustrate another embodiment of the mechanism or system for expelling the fruit by means of star shafts. The olives are expelled by star shafts 64 which are introduced successively into the holes of the cylindrical drum 52. Star shafts 64 are mounted on a shaft 62 which is supported from the main shaft 57 by means of shafts or arms 63. Shaft 62 is provided with as many stars or groups of star shafts 64 as there are transverse or circumferential rows of holes in the drum 52.

Since the star shafts 64 should be introduced into successive holes of the drum 52, the passage or chordal spacing between each two successive points of the star shafts 64 should be the same as the passage or chordal spacing between two consecutive holes of the drum 52.

To aid the star shafts in expelling the olives, the stars or star shafts 64 are imbedded in a rubber cylinder having a peripheral surface tangent to the drum 52. The purpose of such rubber roller or cylinder is to cover the holes of the drum 52, to thus prevent the olives, on being pushed out by the points of the star shafts 64, from sticking to the side edges of the points of the star shafts due to any residual suction.

With reference again to FIGS. 7 and 10, there are shown therein additional structural features common to all the olive expelling mechanisms of FIGS. 5 through 10. These common features are always incorporated in the machine independently of the specific expelling mechanism with which the cylindrical drum is provided. Such features operate in the following manner:

1. The fastenings which support the roller, the comb shaft or the star shaft are adjustable in height. Such fastenings 65 are adjustable in height and include clamps 66 and 67, clamps 66 having downwardly extending studs 68 which telescopically extend into the clamps 67, studs 68 being screwed interiorly into clamps 67.

2. A vibration preventing roller 70 is mounted on an end of the shaft 57 by means of a support 69 supported on the shaft 57, so that the roller 70 is supported by a lug and housing of support 69. Roller 70 serves as a supporting point for the rotation of the cylindrical drum 52, therefore preventing shakes and vibrations.

3. The shaft 57 of the drum is supported by means of a support 71 and a rod 72 to the front face of the suction tube 73.

4. An olive selection brush 74 is mounted above the cylindrical drum 52 and has the purpose of removing therefrom the olives which are not properly aligned in the holes thereof. The brush 74 is rotatably mounted on a shaft 75 which, in turn, is mounted on an extension of the rod 72. Brush 74 has on its periphery circumferentially extending recesses aligned with circumferential rows of the holes of the drum 52. Thus, brush 74 has circumferentially extending projections aligned with the non-perforated zones of drum 52. In this way any olives which are not correctly aligned in holes of the drum are expelled back to hopper 1 by the brush 74.

5. Since the olives are situated on the cylindrical drum due to the suction applied to the interior of the drum, and since some olives may be held by suction even when not perfectly aligned in the holes, there is always the possibility that some olives will be retained by the suction in areas circumferentially between properly aligned olives. Such olives will pass through the circumferential recesses of brush 74. Thus, there is provided a plurality of small wedges 76 on the outer surface of the cylindrical drum 52. Small wedges 76 are positioned circumferentially between the holes of the drum 52. One side of each wedge is an extension of the radius of the drum 52. When an olive is placed in a hole of the drum 52 and such olive does not perfectly close the suction through such hole, the suction may then tend to retain a second olive. But since the space between the well-situated olive and the wedge 76 is small, the second olive cannot fit and therefore will not be retained. Thus, any such second olives which due to the suction are otherwise capable of being retained pass through the recesses of the brush 74, the wedges 76 will prevent their retention on the drum 52, and the drum will reach the unloading zone without olives maintained at positions other than the holes.

Finally, when a faulty olive is rejected by a jet of air under pressure by a corresponding electrovalve 25, such jet of air can affect satisfactory adjacent olives. Therefore, an olive without any defect could also be rejected.

Figure 11:
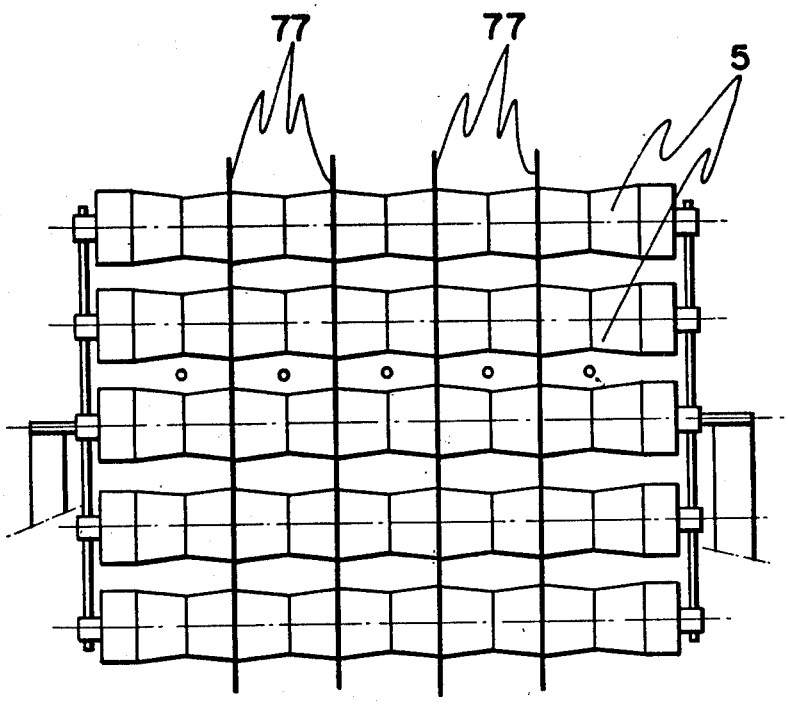
FIG. 11 is a plan view which illustrates the arrangement of separating partitions according to a feature of the machine of the present invention.
Figure 12:
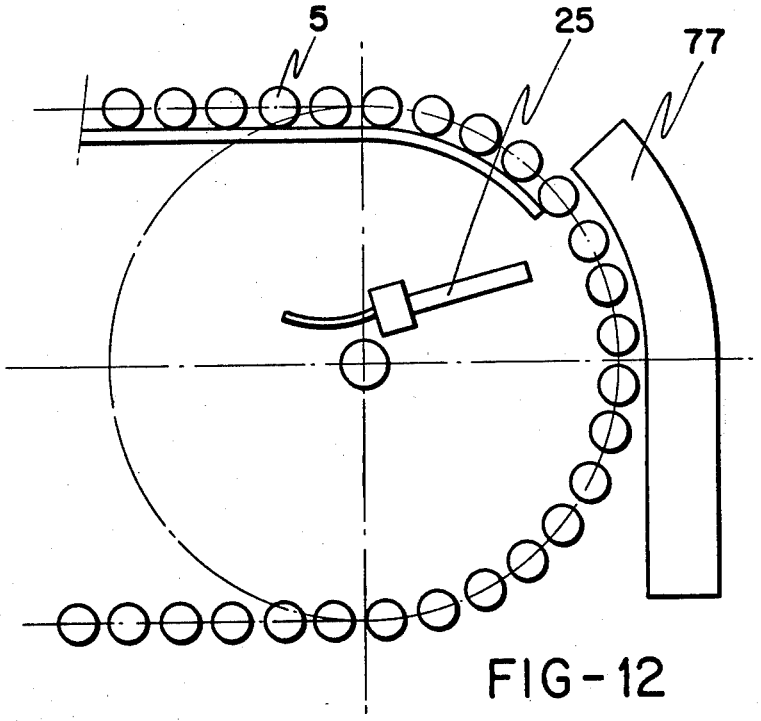
FIG. 12 is an elevational view of the assembly shown in FIG. 11.

To prevent this, plates 77 acting as separating partitions are placed in the olive discharging zone at positions separating adjacent rows of olives, as clearly illustrated in FIGS. 11 and 12.

We claim:

1. In an electronic fruit grading machine of the type including an endless conveyor movable in a longitudinal direction from an upstream fruit supply position to a downstream fruit discharge position, said conveyor being formed of positioning bars extending transversely of said longitudinal direction, said bars including means for receiving and supporting fruit in longitudinally and transversely extending rows, hopper means at said fruit supply position for a supply of fruit to be graded, means for transferring fruit from said hopper means to said receiving and supporting means, whereby fruit is moved by said conveyor toward said fruit discharge position, electronic means positioned adjacent said conveyor at a location between said fruit supply and fruit discharge positions for scanning said fruit to detect undesired surface conditions thereof and for generating signals representative thereof, and reject means positioned at said fruit discharge position and connected to said electronic means and operable upon receipt of said signals for rejecting from a normal discharge path any said fruit having said undesired surface conditions, the improvement wherein said transferring means comprises:

a hollow cylindrical drum adjacent said hopper means and above said conveyor at said fruit supply position, said drum being supported by an axial shaft extending transversely of said longitudinal direction, said drum having formed therein a plurality of holes, said holes being arranged about said drum in circumferential and transverse rows aligned respectively with said longitudinal and transverse rows of fruit on said conveyor;

means for rotating said drum about said axial shaft;

suction means connected to said drum for creating in the interior of said drum a vacuum capable of retaining fruit from said hopper means against said holes, whereby upon rotation of said drum the thus retained fruit is carried by said drum toward said conveyor;

selection means, positioned above said drum and having recesses spaced from the outer surface of said drum at areas aligned with said circumferential rows of holes and projections adjacent said outer surface of said drum at areas between adjacent said circumferential rows of holes, for preventing fruit which is positioned between transversely adjacent holes from being retained by said vacuum;

wedge means located on said outer surface of said drum, at positions between circumferentially adjacent said holes, for preventing fruit which is positioned between said circumferentially adjacent holes from being retained by said vacuum; and fruit expelling means, supported by said axial shaft of said drum eccentrically within the interior of said drum, for expelling fruit retained on said drum when said fruit, due to rotation of said drum, is moved to a position above said conveyor, and for thereby allowing said fruit to be discharged into said receiving and supporting means.

2. The improvement claimed in claim 1, wherein said reject means comprise electrovalves for directing jets of air against said fruit having said undesired surface conditions, and further comprising separating partitions positioned between transversely adjacent said fruit at said fruit discharge position for preventing a said jet of air directed at one fruit from unintentionally interfering with a transversely adjacent fruit.

3. The improvement claimed in claim 1, further comprising means for adjusting the relative spacing between said axial shaft and said fruit expelling means within the interior of said drum.

4. The improvement claimed in claim 1, wherein each said wedge means includes a face which is an extension of a radius of said drum.

5. The improvement claimed in claim 1, wherein said selection means comprises a rotatable brush extending transversely above said drum, said recesses extend circumferentially around said brush, and said projections extend circumferentially around said brush.

6. The improvement claimed in claim 1, wherein said fruit expelling means comprises a cylindrical roller made of elastic material and positioned to roll with pressure against the inner surface of said drum.

7. The improvement claimed in claim 1, wherein said fruit expelling means comprises a plurality of rods arranged in star-shaped configurations, the number of said configurations equaling the number of circumferential rows of holes in said drum, said configurations being supported for rotation on a support shaft in a manner such that during rotation of said drum, said rods of said configurations successively penetrate through respective of said holes, thereby discharging said fruit therefrom.

8. The improvement claimed in claim 1, wherein said fruit expelling means comprises discs supported for rotation about a first axis, plural first shafts supported by said discs, said first shafts each supporting plural prongs adapted to extend through respective holes in said drum, second shafts connected between axially adjacent said prongs, at least one ring mounted on said second shafts eccentrically with respect to said discs, such that upon rotation of said drum, said prongs are successively penetrated through respective of said holes, and said ring rotates about a second axis parallel and eccentric to said first axis.

* * * * *